US005171064A

United States Patent [19]

Boussaroque

[11] Patent Number: 5,171,064

[45] Date of Patent: Dec. 15, 1992

[54] CONVERTIBLE SEAT HAVING A FOLDAWAY HEADPIECE

[76] Inventor: Bertrand J. Boussaroque, 163, Boulevard Clemenceau, 59700 Marcq en Baroeul, France

[21] Appl. No.: 612,061

[22] Filed: Nov. 13, 1990

[30] Foreign Application Priority Data

Dec. 1, 1989 [FR] France ..... 89 16425

[51] Int. Cl.[5] ..... A47C 7/36

[52] U.S. Cl. ..... 297/391; 297/284.4; 297/112

[58] Field of Search ..... 297/391, 408, 284 C, 297/284 R, 112, 114, 61, 397

[56] References Cited

U.S. PATENT DOCUMENTS

| | | | |
|---|---|---|---|
| 2,652,101 | 9/1953 | Samsky et al. | 297/114 |
| 3,742,526 | 7/1973 | Lillard | 297/456 |
| 3,902,759 | 9/1975 | Monteforte et al. | 297/456 |
| 4,420,186 | 12/1983 | Vogt | 297/114 |
| 4,518,203 | 5/1985 | White | 297/456 |

FOREIGN PATENT DOCUMENTS

| | | | |
|---|---|---|---|
| 2750103 | 5/1979 | Fed. Rep. of Germany | 297/408 |
| 1420264 | 10/1965 | France | 297/391 |

*Primary Examiner*—James R. Brittain
*Assistant Examiner*—Milton Nelson, Jr.
*Attorney, Agent, or Firm*—Harrison & Egbert

[57] ABSTRACT

A seat, such as a settee, armchair, lounge or foyer sofa, having a padded framework forming a seat portion having a seating cushion and a back area having a back cushion. A fold-away convention arrangement is provided having a headpiece hinged to the back area so as to have a retracted position behind the back cushion and an unretracted position extending upwardly above the back area. The back cushion is hinged to the seating cushion. A headpiece cushion is fixed by an edge to an upper portion of the headpiece. A back support cushion 1 is attached to the lower portion of the headpiece. A hollow is provided in the back area so as to receive the headpiece cushion and the back support cushion when the headpiece is in a retracted position.

4 Claims, 5 Drawing Sheets

Figure 3:
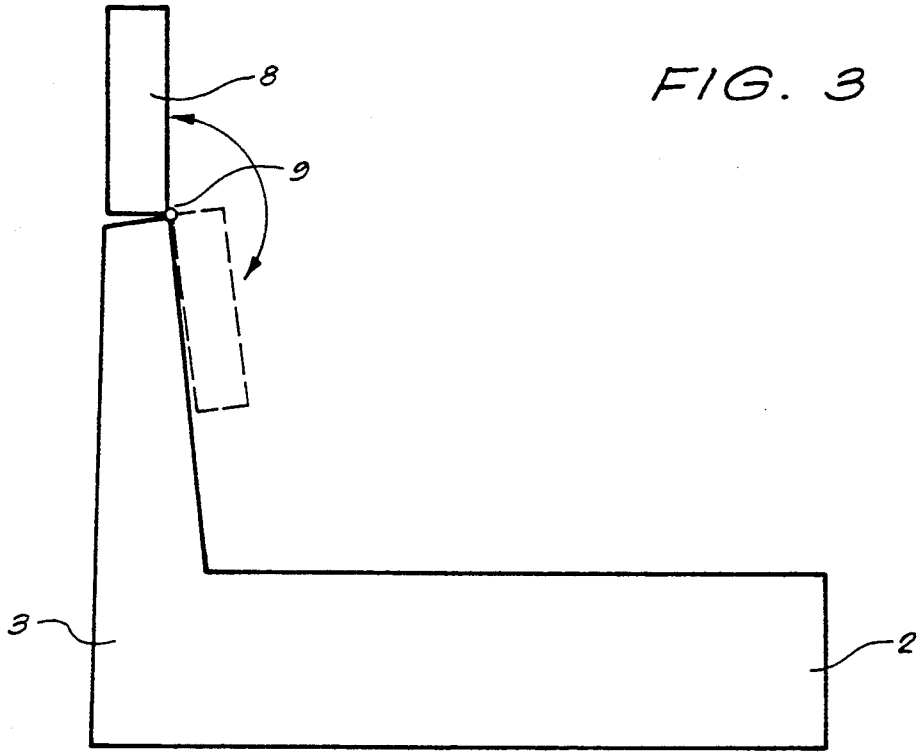

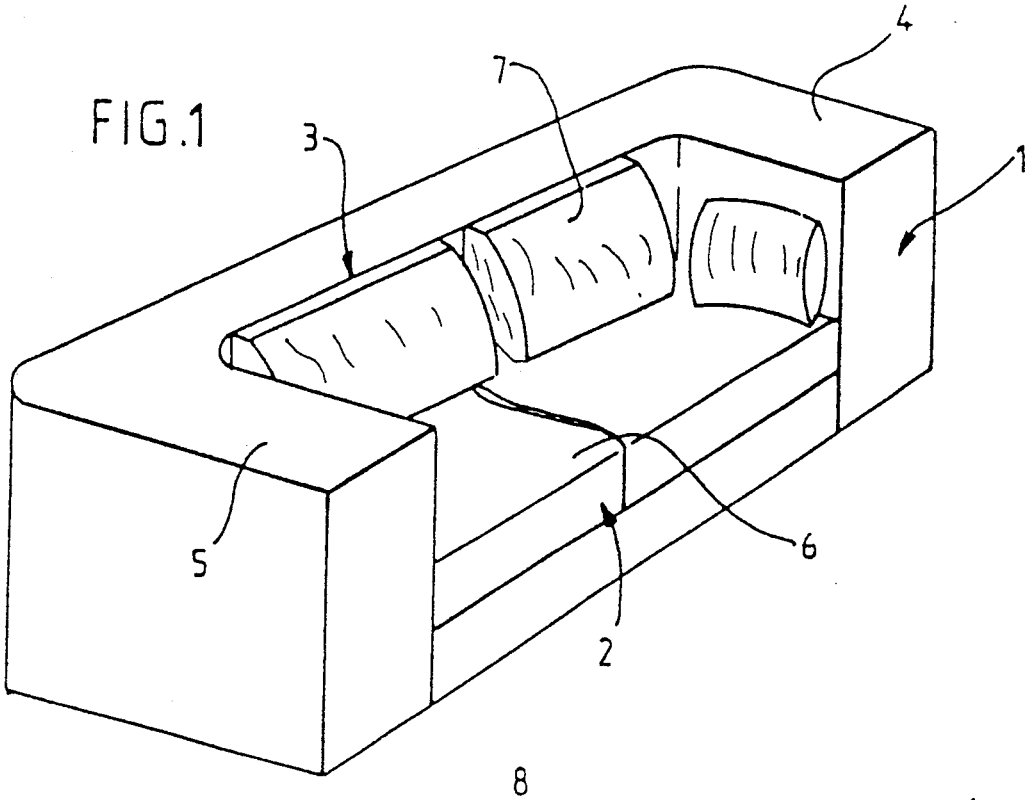
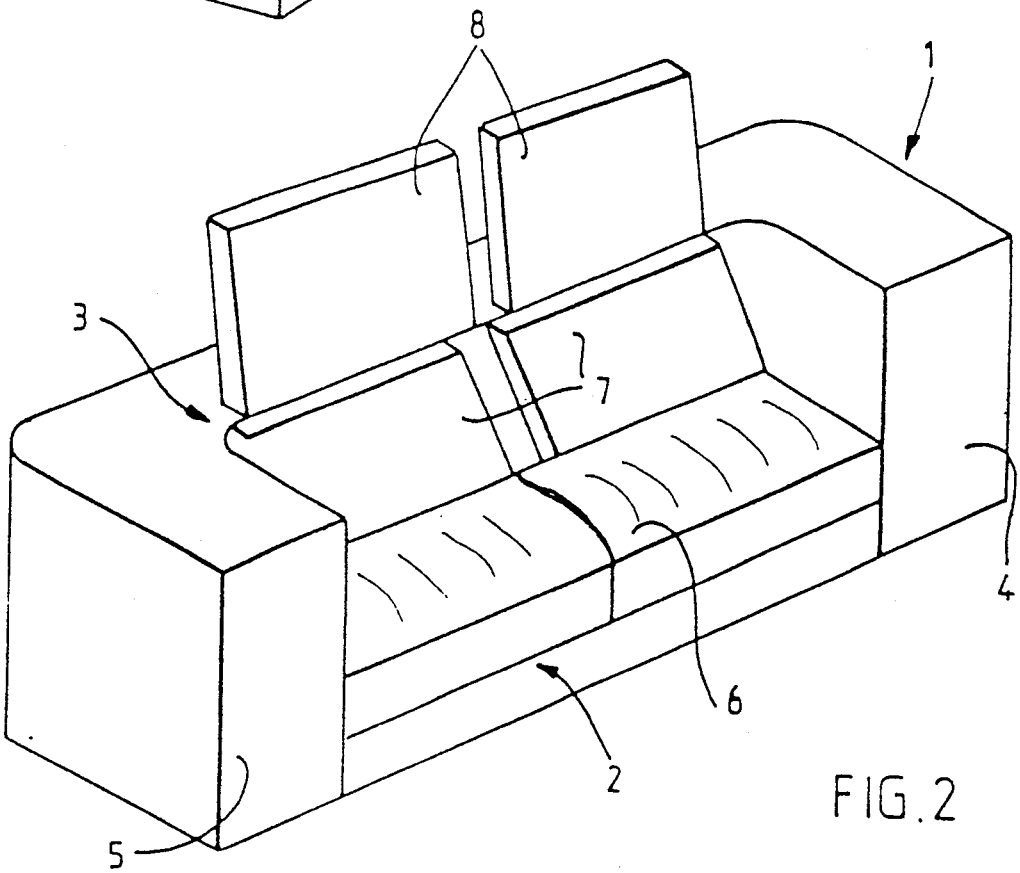
FIG.2

CONVERTIBLE SEAT HAVING A FOLDAWAY HEADPIECE

The invention relates to a seat, such as an armchair, a settee or a wall sofa for a lounge or foyer. It will find an application in particular with furniture manufacturers.

Although the invention has been more especially developed in connection with the manufacture of settees or divans for domestic use, it can also easily be extended to seats in general comprising at least a back.

Furniture manufacturers are faced with two problems. On one hand, they have to offer their customers aesthetically pleasing products which can, of course, be of different styles and, on the other hand, such units have to be functional and comfortable. It sometimes proves difficult in practice to reconcile these two aims.

In general, it is the aesthetic aspect that takes precedence. This is, indeed, the first element to be taken into consideration by the purchaser who, initially, inspects what is offered to him. The item purchased also has to be in keeping with the style of the room in question and, consequently, the purchaser is more or less guided in his choice, all the more in that he very often has some idea of the style he is looking for upon entering the store.

As regards seats, those in the style of bygone years were relatively high so as to be comfortable, and this was quite in keeping with the constructions of the time, with their large rooms and high ceilings.

In the case of contemporary furniture, modern style is more attuned to the functional dwellings with which we are familiar nowadays. Appartments, and even houses, have rooms that are relatively small and, in particular, have quite low ceilings. As a result, the lines of modern furniture are more compact. The shapes are rounded to give a feeling of softness and comfort. In their manufacture, use is generally made of a wooden or metallic framework padded with polyurethane foam and covered with an upholstering material that can be removed for cleaning. Modern style lends itself perfectly to the manufacture of bed-settees. These are settees the seat portion of which can be unfolded to form a bed or which conceals a fold-away bed base. This is a very valuable feature, much sought after nowadays as a means of providing a spare bed.

The use of polurethane foam padding makes it comfortable to sit on the seat portion which can, moreover, be reinforced by a base part comprising springs, slats or other elastic elements.

However, this style of contemporary furniture does prove lacking in comfort in the event of prolonged use. For example, when the settee or armchair is used to watch a television program with the family, its relatively low back is a disadvantage as there is inadequate support for the upper portion of the back, which cannot rest on a supporting element. The second element of discomfort is the practically vertical slope of the back. It is, in fact, more comfortable to be able to recline somewhat on the seat, rather than have one's back straight.

Certain furniture manifacturers have specially designed comfortable seats for elderly persons, in which the above-mentioned drawbacks have been removed. For this purpose, the seat is automatically provided with a very high back to give the user not only support for the back but also for the head. Secondly, the seat portion is mounted on a slide so that it can have at least two positions. One is straight, in which case the seat portion is pushed into the seat and the back is straight. In the other position, the seat portion is moved towards the front of the seat and the back inclines, following the movement of the seat portion, thus providing a position in which the user is more reclined.

In terms of comfort, this type of seat gives complete satisfaction; on the other hand, aesthetically speaking, this is much more debatable. Indeed, the back is very high and the seat cannot, therefore, be easily integrated into a modern setting. It should also be emphasized that this type of furniture is very heavy as it comprises an extensive mechanism using numerous slides and compensating springs. Finally, this is a very expensive, heavy and cumbersome piece of furniture and one which can thus be of interest to only a limited number of customers.

The object of the present invention is to provide a seat such as a settee that is compatible with the contemporary constraints of modern aesthetics, that is to say a low line that can be converted to become comfortable, i.e. offer the users a back-rest that extends right up the back, as well as a head-rest, the unfolded back being inclined to allow the occupant to adopt a more reclining position.

This is, therefore, a piece of furniture that is perfectly aesthetic in the event of social gatherings or when not in use, and which can be converted into a comfortable seat for the family circle when, for example, one watches television.

It should be emphasized that this convertibility according to the present invention is fully compatible with bed-settee conversion. This is an additional option.

Another advantage of the present invention is that it is completely invisible when the settee is in the so-called "aesthetic" position, so as not to detract from its lines. On the other hand, the conversion necessary in order to benefit from the features of the invention does not render the seat any heavier and remains relatively inexpensive, which is no handicap to the price of the product.

The seat, such as a settee, which is of interest to furniture manufacturers, comprises an padded framework forming a seat portion, a back and possibly arm-rests, fitted with cushions. It is characterized by the provision of fold-away means which, when they are put into place, make the settee or seat comfortable by raising the back to afford an area to support the whole of the back and also a head-rest, this being achieved without prejudice to the aesthetic appearance of the said seat when the said means are folded away.

Figure 4:
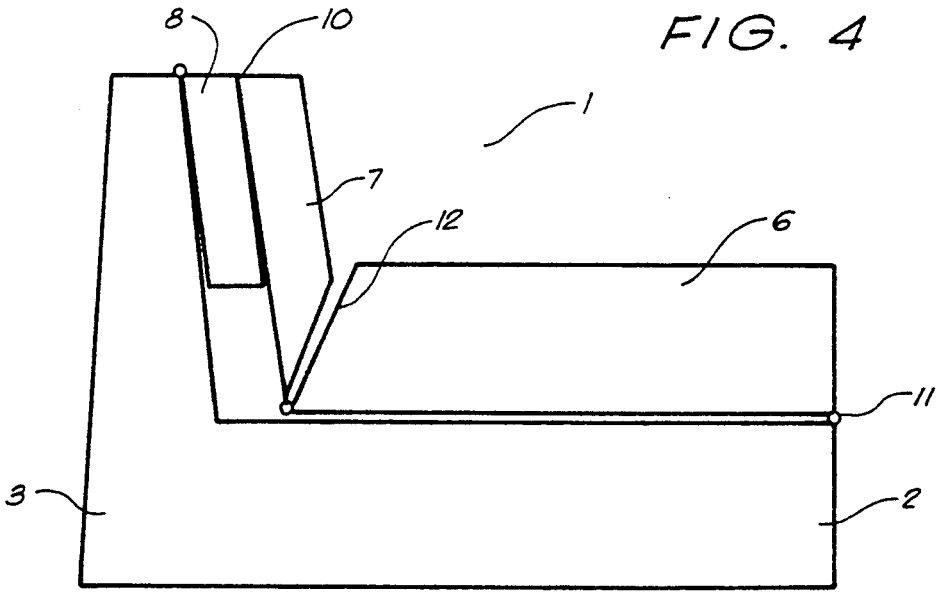
Figure 5:
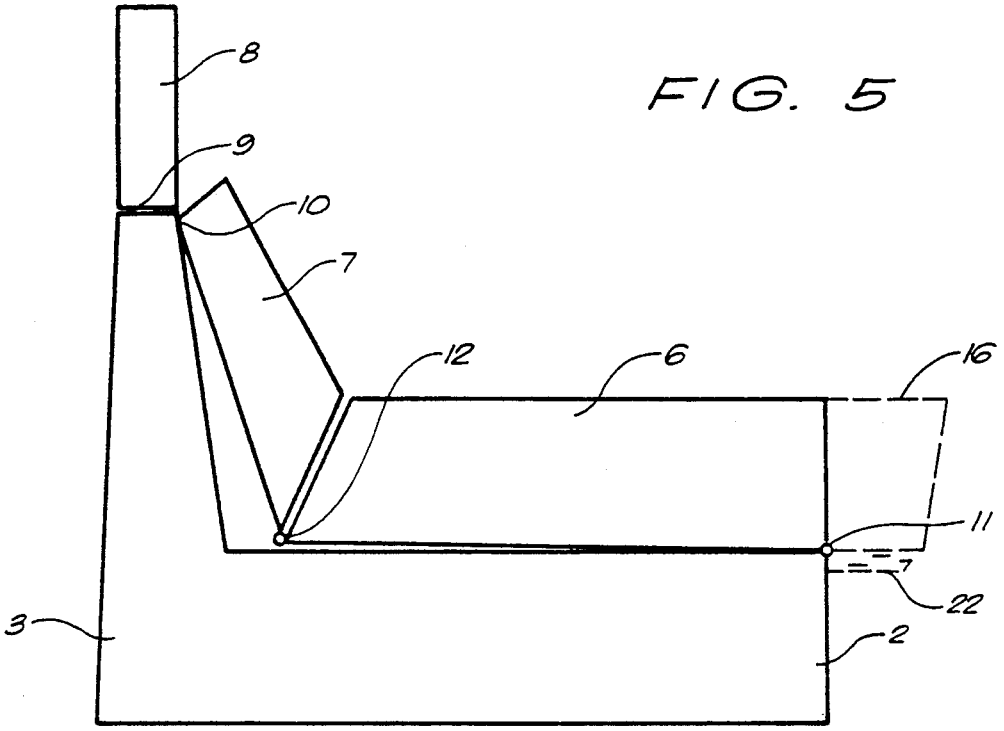
Figure 9:
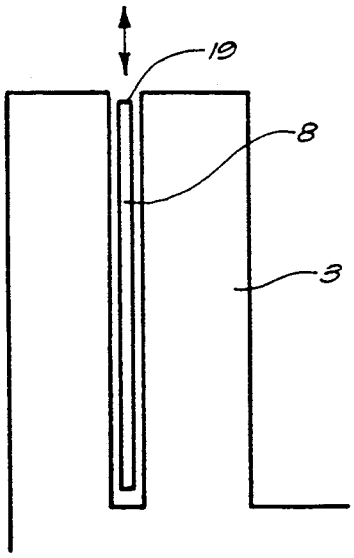
Figure 10:
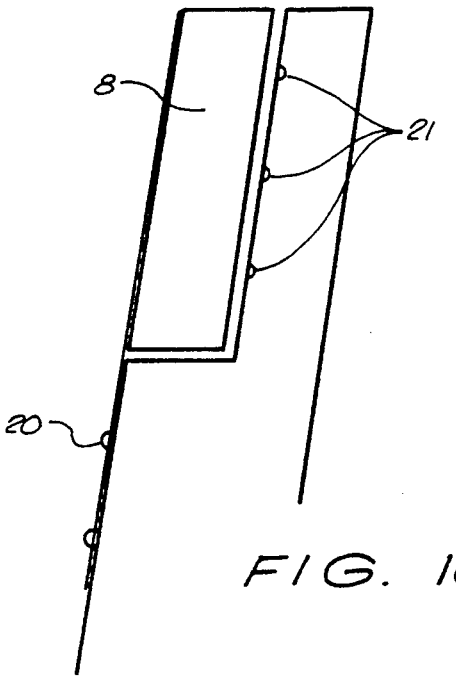
Figure 6:
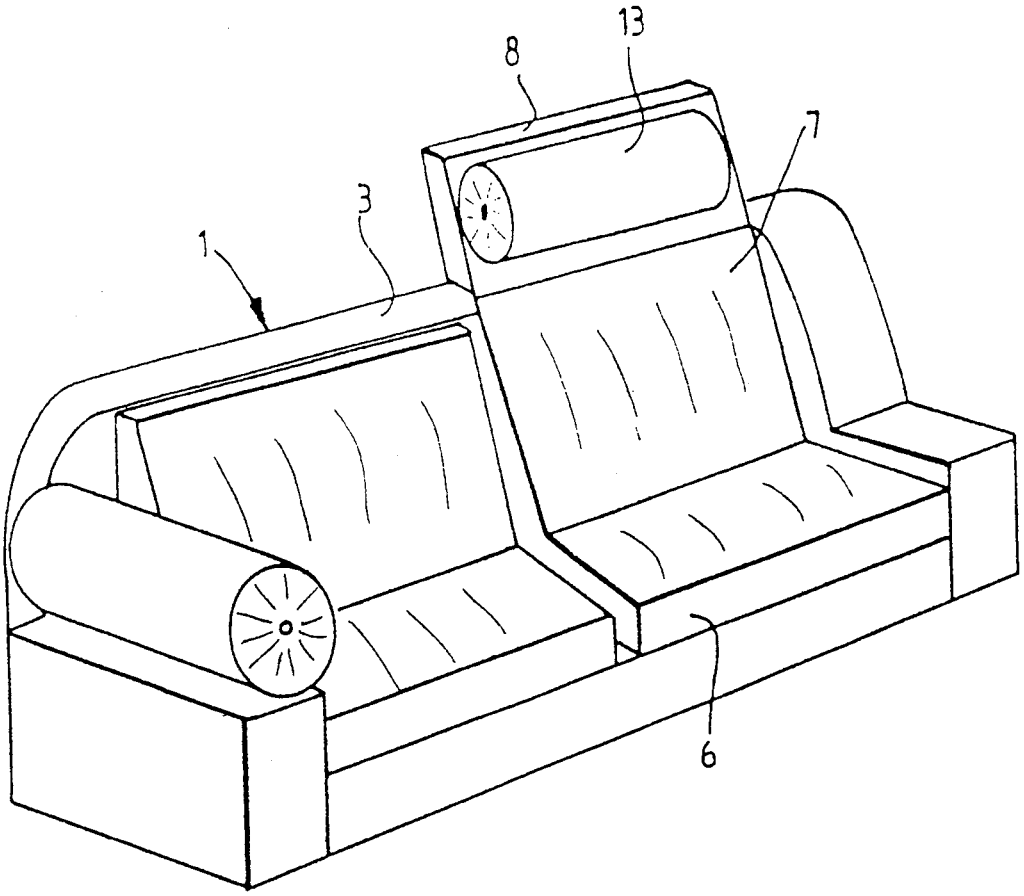
Figure 7A:
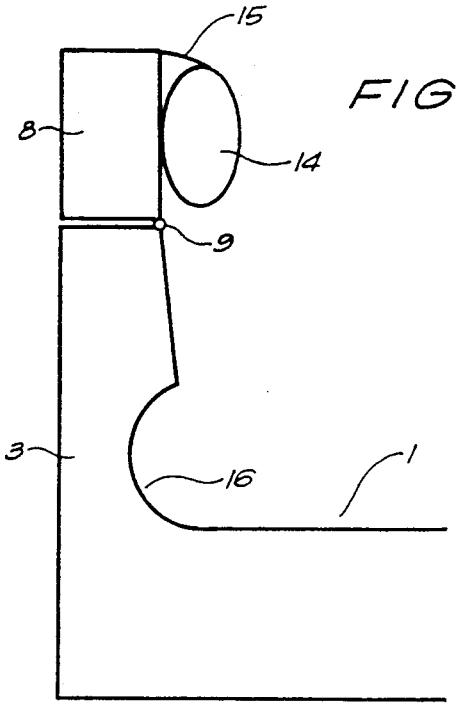
Figure 7B:
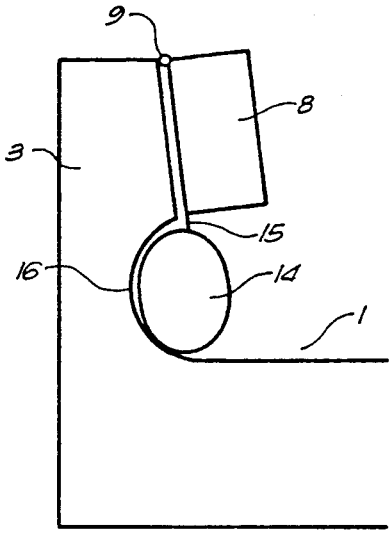
Figure 8A:
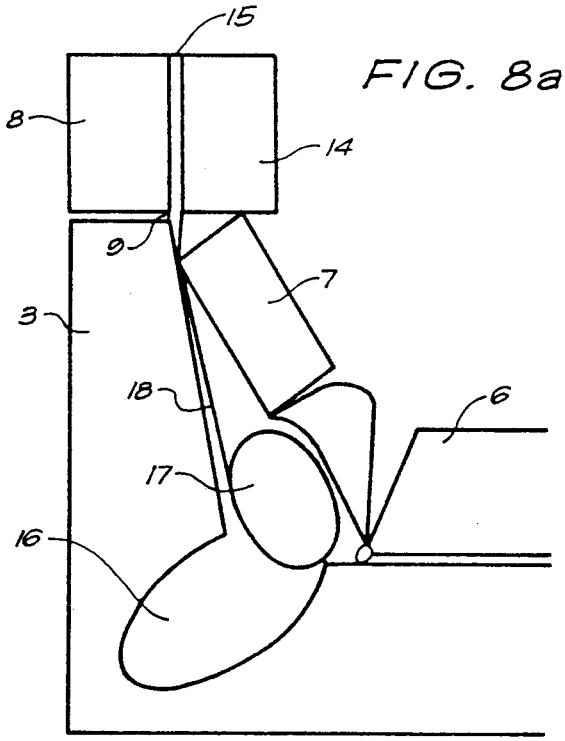
Figure 8B:
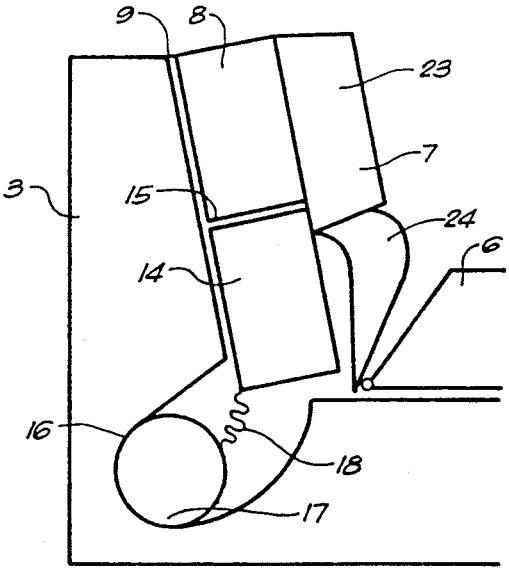

The invention will be more readily understood by reading the following description, accompanied by the annexed drawings, wherein:

FIG. 1 schematically represents a lounge settee viewed with its aesthetic lines, FIG. 2 represents the lounge settee of FIG. 1 when the comfort-giving elements are unfolded, FIG. 3 is a cross-sectional view showing the unfolding of the head-piece, FIG. 4 is a schematic cross-sectional view of the lounge settee according to the invention with the head-piece folded back, FIG. 5 shows the lounge settee according to the invention when the head-piece is unfolded and the back cushion is inclined, FIG. 6 shows the use of the arm-rest cushions as head-rest cushions, FIGS. 7*a* and 7*b* schematically represent a form of embodiment of the present invention in which the head-pieces further include a head-rest cushion, in unfolded and folded back positions respectively, FIGS. 8*a* and 8*b* show a variant of FIG. 7, equipped with a cushion to support the small of the back, in unfolded and folded back positions respectively, FIG. 9 shows a variant in which the head-piece slides down into the thickness of the back, FIG. 10 shows another variant in which the head-piece can be fixed to the back of the settee at different height-adjustable positions.

The present invention relates to a seat such as a settee, an armchair or a lounge or foyer sofa which will find an application in particular with furniture manufacturers.

More generally speaking, the invention can perfectly well be applied to any seat, provided that it is equipped with a back.

When different objectives have to be met, certain incompatibilities between the required features are sometimes revealed. This applies notably to items of furniture when they have to meet certain aesthetic criteria of style and a desire for comfort.

Contemporary furniture tends to have compact, low lines to match the low-ceilinged rooms of present-day houses. Unfortunately, this can only be achieved by manufacturing furniture with low backs, which makes it impossible to offer the user a soft supporting surface for the whole of the back. This represents a major handicap when the furniture is used in a family setting, where aesthetic considerations matter little but where comfort is important when, for example, watching television.

On the other hand, the so-called "high-comfort" seats with the benefit of a very high back and at least a dual sitting position, upright or reclining, are completely unaesthetic, very heavy, cumbersome and costly, and generally provide only seating for one person.

The object of the present invention is precisely to provide a seat with means for giving it both a low-lined modern aesthetic appearance similar in every respect to existing contemporary furniture, and a second, comfortable position for which aesthetic considerations are less important or different when comfort takes precedence.

By way of example, the means according to the invention have been provided on a contemporary settee such as the one illustrated in FIG. 1 and designated by the number (1), although they could also be used in an armchair or any seat in general equipped with a back.

The lounge settee (1) comprises a framework that is generally of wood or metal, padded and covered with an upholstering fabric similar to the products currently manufactured. This framework forms a seat portion (2) and a back (3) framed in the present case by arm-rests (4 and 5). The seat portion (2) and the back (3) are equipped respectively with cushions (6 and 7).

FIG. 1 intentionally illustrates a lounge settee that is modern in style, i.e. having a very short back which is here at the level of the arm-rests (4 and 5). Aesthetically, there is nothing to suggest that the lounge settee of FIG. 1 contains the fold-away conversion means of the present invention.

When they are put into place, the fold-away conversion means of the invention provide the settee as illustrated in FIG. 2 with certain high-comfort features.

These conversion means take the form of head-pieces (8), made in one or more parts as illustrated in FIG. 2, which unfold in the upper portion of the back (3) so as to be raised and afford a comfortable area of support for the whole of the settee user's back, as well as allowing him to rest his head on it. In the example chosen, the two head-pieces illustrated (8) are independent and can be put into place individually.

This is a settee to seat two persons and thus comprising two head-pieces; a man of the art will easily be able to adapt the number of head-pieces to suit the number of persons intended to occupy the seat.

A second element of comfort should be stressed: when the head-pieces (8) are unfolded, the angle of inclination of the back cushions (7) is greater. At the same time as the head-pieces (8) are put into place, one obtains an additional inclination of the cushions (7), which makes it easier for the occupant to adopt a more reclining position because thickness of the back is, for example, halved.

FIG. 3 schematically represents the implementation of the conversion means, which take the form of a head-piece (8) that can be folded back onto the back (3). It should be emphasized that the head-piece (8) is preferably articulated about the upper median portion (9) of the back (3), which enables the upholstering fabric to be pulled taut and cover perfectly the top of the back when the head-piece (8) is folded back against the back (3). On the other hand, when the head-piece (8) is unfolded, the upholstering fabric folds back between the head-piece and the back without creasing. In the example chosen, the head-piece (8) and the upper portion of the back (3) are of the same thickness, which justifies the choice of the median portion for folding purposes; however, this feature is not essential.

The head-piece (8) is halted in its unfolded position preferably by an elastic stop. This enables the inclination of the head-piece (8) to be modified when one leans against it, which provides an additional element of comfort.

The elastic stop is obtained very easily through compression of the surface padding of the back (3) and of the head-piece (8).

The conversion means of the invention also take the form of a back cushion (7) which is articulated in relation to the seat portion cushion (6), i.e. inclinable. Furthermore, the back cushion (7) has a mobile upper stop (10). Thus, according to the resting position of the upper stop (10), the cushion (7) can be more or less inclined.

FIG. 4 is a cross-sectional view of the different elements of the lounge settee according to the present invention. The seat-portion cushion (6) is itself fixed by an edge (11) on the front of the settee (1). The back cushion (7) is made integral by an edge (12) with the seat portion cushion (6), which enables it to be articulated in relation to the latter, for the purpose of making a bed, for example. The articulations in question are of the textile type, preferably a zip fastener being used, one side of which is integral with the back cushion (7) and the other side of which is integral with the seat portion cushion (6). Similarly, as regards the edge (11) connecting the seat portion cushion (6) to the framework of the settee (1), use is very often made of a simple textile hinge which is, itself, invisible. One could also use a zip fastener one of the sides of which is integral with the seat portion cushion (6) and the other side of which is integral with the upholstering fabric of the settee (1). It is also possible to use a simple textile strip sewn onto each of the pieces, or a fastening system using hooks and eyes or press-studs in place of the zip fasteners.

The use of zip fasteners makes it possible, if necessary, to remove the item for cleaning purposes.

According to the invention, the stop of the back cushion (7) is constituted by the head-piece (8), as illustrated in FIG. 4. In this case, when the head-piece (8) is folded back against the back (3), the cushion has a straighter position as the supporting stop (10) is located forward.

On the other hand, when the head-piece (8) is unfolded, as illustrated in FIG. 5, the supporting stop of the back cushion (7) is moved rearwards right back into contact with the back (3). In this case, the cushion (7) is more inclined. The seat portion cushion (6) is, in fact, fixed owing to its connection (11) with the lining of the settee, hence the connecting edge (12) is also fixed and, owing to the lesser thickness of the back (3), since the head-piece (8) is unfolded, the cushion (7) is inclined. This enables the occupant to benefit from a more reclining position.

The manufacturer can determine the degree of inclination of the cushion (7) through the choice of thickness of the head-piece (8).

It should be noted that this additional inclination of the back cushion (7), when the settee is in the comfort position, induces the occupants to place a cushion (13) on the head-piece (8), as illustrated in FIG. 6, to supplement the padding of the head-rest and thus enhance the comfort of the reclining position. For this purpose, the occupants take a cushion that comes readily to hand, and generally use the arm-rest cushion, which is not designed for this purpose. This can prove inconvenient as it will tend to become soiled more easily and, moreover, if the cushion is used as a head-rest, the arm-rest will have no cushion.

This is why, according to the present invention, as shown in FIG. 7, the head-piece (8) is advantageously provided with a cushion (14) which is attached to the upper portion of the head-piece (8) by a flexible connection (15). This flexible connection can be either a textile strip or a zip fastener, the latter solution having the advantage that the cushion (14) can be removed for cleaning.

Concurrently, the back (3) of the seat (1) has at its base a hollow (16) in which the cushion (14) can be accommodated when the head-piece (8) is folded back against the back (3), as illustrated in FIG. 7*a*.

The hollow (16) has been judiciously chosen to be at the base of the back (3) as, here, the cushion (14) does not have to be completely fitted into the hollow (16); it can, in fact, project slightly and protrude according to the thickness of the head-piece (8) without forming a bulge beneath the cushion (7) of the back.

Furthermore, as shown in FIG. 7*a*, the cushion (14) is automatically put into place when the head-piece (8) is unfolded. Being attached to the head-piece (8) by the strip (15), the cushion (14) is placed of its own accord against the head-piece (8). Similarly, when the head-piece (8) is folded back, the cushion (14) comes into place below the head-piece (8) and in the hollow (16) in the back.

In another variant of the present invention, as illustrated in FIGS. 8*a* et 8*b*, a cushion (17) is further provided to support the small of the back.

FIG. 8*a* shows the structure of the seat and, as in the case of the previous form of embodiment, a head-piece (8) articulated at (9) on the back (3), as well as a head-rest cushion (14) articulated at (15) on the said head-piece (8). These two elements (8 and 14) function according to the same principle as in FIGS. 7*a* and 7*b*, and FIGS. 8*a* and 8*b* show the positions with the head-piece out and with the head-piece and head-rest folded back respectively.

However, the essential difference in relation to the preceding form of embodiment is the presence of the cushion (17) to support the small of the back connected to the head-rest cushion (14) by a flexible strip (18).

In unfolded position, as shown in FIG. 8*a*, the head-piece (8) is completely unfolded, the head-rest cushion (14) comes to rest on the head-piece, and the strip of fabric (18) enables the cushion (17) to support the small of the back to be maintained in the desired position for the back cushion (7) to be firmly maintained.

On the other hand, in folded back position, as seen from FIG. 8*b*, that is to say in a position wherein the head-piece (8) is not in use, the latter, by means of the articulation (9), returns to the fold-away position, while the head cushion (14) comes back in prolongation thereof along the back (3).

Through the effect of gravity, the cushion (17) to support the small of the back locates itself in the hollow (16) provided at the base of the seat between the back and the seat portion. One can then place back over the assembly of folded elements (8,14) the back cushion (7), which can take, for example, two different forms: a first, upper, cushion having a rectangular cross-section (23) and a second, lower, cushion having a circular portion (24) suitable for mating with a portion of the perimeter of the cushion (17) to support the small of the back.

In the preceding examples, the movement of the head-piece (8) is a rotary movement, which represents the preferred form of embodiment of the invention. However, other movements could also be chosen, such as a translation movement.

FIG. 9 represents a form of embodiment of the back (3) in which the head-piece (8) slides into a slit (19) provided in the thickness of the back (3).

Another form of embodiment is shown in FIG. 10, in which the head-piece (8) has fixing means (20) that cooperate with complementary fastening means (21). These means (20) have been provided at different heights to permit height adjustment of the position of the head-piece (8) according to the user's wishes.

In FIG. 5, the lower cushion (6) is mounted on a slide so that it can be pulled forward to a position (22) such as the one represented in dotted lines, thus increasing the inclination of the back cushion (7).

I claim:

1. A seat, such as a settee, armchair, lounge, or foyer sofa or other seat comprising:

a padded framework forming a seat portion having a seating cushion and a back area having a back cushion;

a fold-away conversion means having a headpiece hinged to said back area so as to have a retracted position behind said back cushion, said headpiece in said retracted position interposed between said back area and said back cushion, said headpiece having an unretracted position extending upwardly above said back area, said seating cushion hinged to said back cushion, said back cushion having a stop area in abutment with said headpiece when said headpiece is in said retracted position, said back cushion tilted in abutting relationship with said back area when said headpiece is in said unretracted position, said headpiece is articulated by a hinged edge along an upper surface on said back area; and a back support cushion attached to a lower portion of a headpiece cushion by a strip of material having a length suitable for enabling said back support cushion to foldaway into a hollow provided in a base of the back area.

2. The seat according to claim 1, further comprising: said headpiece cushion being fixed by an edge to said headpiece, said headpiece cushion received in said hollow formed at a base of the back area when said headpiece cushion is in said retracted position.

3. The seat according to claim 1, said back cushion is integral with the seating cushion through an edge.

4. The seat according to claim 3, said seating cushion is fixed by an edge to a front of the seat portion.

* * * * *